US007337541B2

(12) United States Patent
Grossiord et al.

(10) Patent No.: US 7,337,541 B2
(45) Date of Patent: Mar. 4, 2008

(54) AUTOMATIC CLASP FOR WRISTWATCH STRAP

(75) Inventors: Claude Grossiord, La Chaux-de-Fonds (CH); Jean-Louis Bohrer, La Chaux-de-Fonds (CH); Frédéric Nicolet, Soceboz-Sombeval (CH)

(73) Assignee: G & F Chatelain SA, La Chaux-de-Fonds (CH)

( * ) Notice: Subject to any disclaimer, the term of this patent is extended or adjusted under 35 U.S.C. 154(b) by 180 days.

(21) Appl. No.: 10/520,844

(22) PCT Filed: Jul. 11, 2003 (Under 37 CFR 1.47)

(86) PCT No.: PCT/FR03/02208

§ 371 (c)(1), (2), (4) Date: Aug. 22, 2005

(87) PCT Pub. No.: WO2004/006710

PCT Pub. Date: Jan. 22, 2004

(65) Prior Publication Data

US 2007/0028586 A1 Feb. 8, 2007

(30) Foreign Application Priority Data

Jul. 11, 2002 (FR) ..... 02 08750

(51) Int. Cl.
*G04D 3/00* (2006.01)
*A44C 5/14* (2006.01)

(52) U.S. Cl. ..... 29/896.3; 24/265 WS

(58) Field of Classification Search ..... 29/412, 29/417, 513, 896.3, 896.41, 896.7; 24/177, 24/327, 331, 335, 340, 346, 265 WS, 71 J, 24/265 BC, 265 EC See application file for complete search history.

(56) References Cited

U.S. PATENT DOCUMENTS

| | | | | |
|---|---|---|---|---|
| 2,001,216 | A * | 5/1935 | Sand | 24/71 J |
| 3,109,229 | A * | 11/1963 | Cataldi | 29/430 |
| 3,682,603 | A * | 8/1972 | Pompeo | 29/896.3 |
| 4,151,014 | A | 4/1979 | Charschan et al. | |
| 4,405,386 | A * | 9/1983 | Mravic et al. | 148/567 |
| 5,309,616 | A * | 5/1994 | Sobin | 29/896.42 |
| 5,689,859 | A * | 11/1997 | Cuche | 24/71 J |
| 5,857,243 | A * | 1/1999 | Champion | 24/71 J |

FOREIGN PATENT DOCUMENTS

| | | |
|---|---|---|
| CH | 471 556 | 4/1969 |
| DE | 621 286 | 11/1935 |
| EP | 0 867 132 | 9/1998 |

* cited by examiner

*Primary Examiner*—David P. Bryant
*Assistant Examiner*—Alexander P Taousakis
(74) *Attorney, Agent, or Firm*—Young & Thompson

(57) ABSTRACT

A clasp and a production method thereof. The inventive clasp includes at least one main element (1) and at least one element (3) which pivots in relation to the main element. The clasp is characterised in that each of the aforementioned elements (1, 3) includes two longitudinal arms which are rolled up to form a hinge (7, 15) . Moreover, at least one of the ends of one of the elements (1, 3) includes a flexion spring (11) which can rest against the other element (3, 1) for the elastic support thereof and each arm (5, 13) of the main element (1) and the pivoting element (3) is provided with at least one longitudinal stiffening rib (20, 22).

11 Claims, 2 Drawing Sheets

AUTOMATIC CLASP FOR WRISTWATCH STRAP

The present invention relates to a clasp of the automatic opening/closure type, particularly for wristwatch strap.

Numerous types of clasps are known, which are essentially constituted by two elements mounted to pivot with respect to each other, at the respective ends of which the two free ends of the straps constituting a wristwatch are connected. The two elements forming such a clasp are thus adapted to occupy two positions, namely a first position, or position of closure, in which the two elements are locked on each other by mechanical holding means, and a second position, or position of opening, in which these two elements are released, thus at the same time increasing the overall diameter of the wristwatch so as to allow the user to easily introduce it on or remove it from his/her wrist.

One drawback inherent in this type of clasp comes from the fact that the devices for locking the two elements which constitute it, either require a considerable effort to ensure locking thereof, or present the risk of not holding the watch strap in complete safety.

In order to avoid this type of drawback, a clasp has been proposed in Patent Application FR-A-2 710 503, in which the two elements are stressed, in position of closure, by elastic means which thus permanently ensure a force tending to maintain the clasp in position of closure. Such a clasp makes it possible to limit the risks of untimely opening of the watch strap.

One drawback of this type of clasp is that, in position of opening, the two elements cannot pivot beyond an angle of 180°, this sometimes rendering it difficult to introduce the user's wrist in the watch strap. Moreover, any effort of opening exerted on these two elements, which tends to cause them to pivot beyond an aligned position, has the effect of irreparably deteriorating the clasp.

This is why a clasp of the aforementioned type has been proposed in Patent EP-A-0 867 132, in which the two elements are respectively constituted by a main element and a pivoting element, the main element comprising a flexion spring stressing an elongation of the pivoting element beyond the articulation, in two stable positions of equilibrium, namely a first position, or position of closure, in which it applies the pivoting element on the main element, and a second position, or position of opening, in which it moves the two elements apart from each other, the pivoting element comprising at least one slot adjacent to the articulation, whose dimensions are such that they allow the flexion spring, when the pivoting element is in the position of opening, to traverse this slot so as no longer to stress said pivoting element. Furthermore, in certain forms of embodiment, the system is one with double development, i.e. the clasp is composed of three elements, namely a main element which comprises at each of its ends an articulation on which a pivoting element is mounted as described previously.

The clasps produced in this way are constituted by pieces machined in the mass and, by reason of the fact that their different constituent elements must respond to contradictory mechanical contraints, they are made of a plurality of assembled pieces. For example, the flexion spring is added by fixation means, such as riveting or welding, on the main element. These different contraints lead to the clasps made in this way usually being intended to equip very high quality wristwatch straps, and this due to their particularly high cost price.

The present invention has for its object to propose a clasp of the aforementioned type intended to be manufactured, not by mechanical machining processes, but by processes for producing pieces of small thickness, such as stamping, folding and cutting out.

The invention also proposes a clasp of this type in which the spring with which the main element is provided forms an integral part of the latter and is not constituted by an added piece. The present invention thus makes it possible to produce a clasp of high mechanical quality at a particularly attractive cost price.

According to the invention, it is thus proposed to produce a main element and a pivoting element which are constituted from a thin foil of stainless steel. Now, it is known that, in the domain of wristwatch straps, the so-called stainless steels are subjected to oxidation stresses which are particularly high, so that very few of these steels prove in reality to be effectively stainless.

However, professionals in these techniques are acquainted with completely stainless steels, even under the particularly severe conditions mentioned previously. However, such steels present, moreover, drawbacks and particularly that of being particularly difficult to master concerning their characteristics of hardness and of elasticity. In effect, these steels are not sensitive to quench hardening, and their hardness is acquired by successive operations of die work or of rolling, which are effected from a sample of steel whose thickness is much greater than that of the final piece. Although such contraints have only an accessory importance when it is proposed to make pieces machined in the mass, they prove particularly awkward when it is question of pieces made from a strip of stainless steel.

Another difficulty resides in the fact that the two elements constituting the clasp, namely the main element and the pivoting element, are formed by parts which must imperatively present very different characteristics of stiffness, since one zone of these elements must be sparingly elastic and sparingly hard in order to be able to be rolled so as to constitute the hinges for receiving the pivot pins, another zone must have a sufficient stiffness to constitute a spring blade making it possible to create the elastic force ensuring that the clasp is held in position of use, and finally a third zone must be rigid in order to counterbalance the stiffness of the spring.

The present invention has for its object to propose a method of manufacture making it possible to produce each of the two elements constituting a clasp, in one piece.

The present invention thus has for its object a method for manufacturing a clasp, particularly for wristwatch strap, from a metal strip, of the type comprising a main element and at least one pivoting element, which are connected at one of their respective ends by an articulation, a flexion spring fastened with one of these elements being applied, at least in position of closure, on the other element in order to hold it elastically in this position of closure, characterized in that it comprises the steps consisting in:

- using a strip whose stiffness is the one desired for the spring,
- making, by cut-out, a blank of each of these elements, so as to form on each of them at least two longitudinal arms, and on the main element two recesses inside the two arms forming between the two arms a central flexion spring,
- subjecting these arms to an annealing exclusively at their ends so as to allow rolling thereof,
- increasing the stiffness of these arms by making at least one rib along the longitudinal axis thereof.

In a first form of embodiment of the invention, the method comprises a step during which a blank band is constituted from a strip constituted by a wound band, of which the width corresponds to one of the dimensions of the element to be produced, each of the blanks constituting the blank band being connected to the blanks which are adjacent thereto by at least one connecting tab. The blanks may be disposed so that their longitudinal axis is oriented perpendicularly to the longitudinal axis of the blank band.

In a step of the method, the blank band will advance, along its longitudinal axis, in front of localized heating means in zones disposed on its transverse edges, so as to effect an operation of annealing on at least one longitudinal band of the blank band. The localized heating means will preferably be constituted by a laser beam.

According to the invention, an operation of rolling will be effected at the end of the arms of the elements, after the heating phase, so as to constitute hinges.

Likewise, two arms of the same end of a pivoting element will be wound so as to constitute a double hinge, namely an inner hinge intended to receive a pivot pin common with the main element and an outer hinge intended to receive a stop pin.

Furthermore, once the end of the arm is wound, the end of the arm may be welded on the element on which it is constituted.

Although for the localized heating operations it is possible to employ various processes, it has been observed that welding by laser beam made it possible to obtain results which are particularly noteworthy by its precision.

The present invention also has for its object a clasp, particularly for wristwatch strap, of the type comprising at least two elements, namely a main element and a pivoting element which is mounted to pivot with respect to the latter by means of an articulation, characterized in that:

- each of these elements comprises at at least one of its ends two longitudinal arms whose ends are rolled up so as to constitute a hinge of said articulation,
- at least one of the ends of one of the elements comprises a flexion spring adapted to come, at least in position of use, in abutment against the other element so as to ensure elastic support thereof,
- each arm of the main and pivoting elements is provided with at least one longitudinal stiffening rib.

The flexion spring will preferably be formed on the main element. Furthermore, the rolling of the arms of that of the two elements which is not provided with the flexion spring may be double, so as to form, on the one hand, a first inner hinge admitting the pivot pin traversing the hinges of the articulation, and a second outer hinge intended to support a stop pin disposed beyond the first pivot pin, towards the outside, and on which the flexion spring will come into abutment when the clasp is in position of use.

In a particularly interesting form of embodiment of the invention, at least the element provided with the flexion spring will be constituted by a stainless steel having a high content of elements such as nickel, chromium, molybdenum, cobalt, the sum of the contents of these elements being greater than 80%.

A form of embodiment of the present invention will be described hereinafter by way of non-limiting example, with reference to the accompanying drawings, in which.

Figure 2:
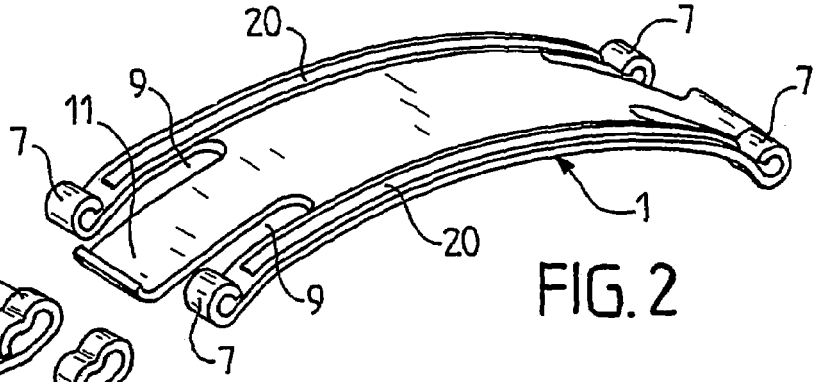
FIG. 2 is a view in perspective of a main element and of a pivoting element before they are assembled on a clasp of double-development type.
Figure 3:
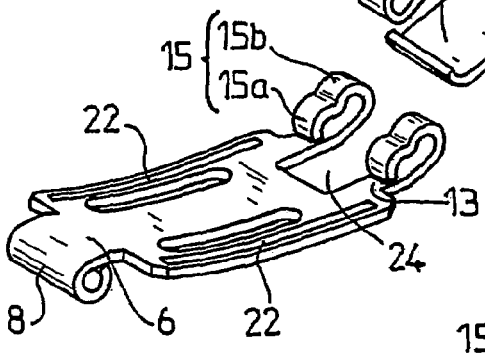
FIG. 3 is a view in perspective of the double-development clasp shown in FIG. 2, the elements constituting the latter being assembled and one of the pivoting elements being in position of opening.
Figure 3:
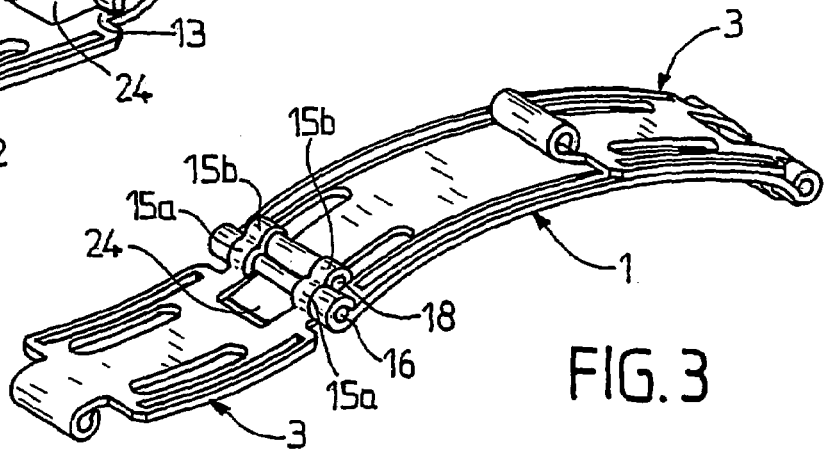
Figure 4:
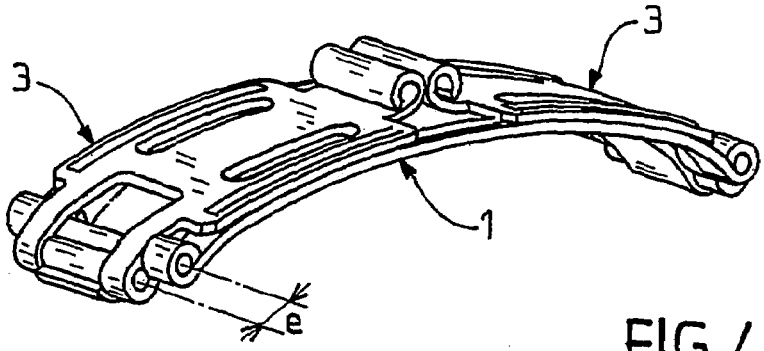
FIG. 4 is a view in perspective of the clasp shown in FIGS. 2 and 3, the two pivoting elements being in position of closure.

The clasp according to the invention which is shown in FIGS. 2 to 4 is of the double-development type, i.e. it is constituted by three essential elements, namely a main element 1 and two pivoting elements 3.

Figure 7:
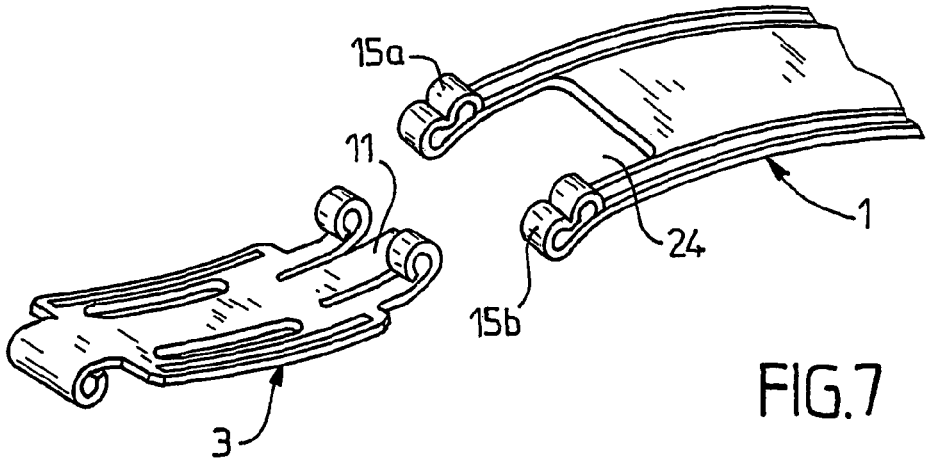

FIG. 7 is a view in perspective of a variant embodiment of a clasp according to the invention.

The main element 1 is curved and terminates at each of its two ends by two arms 5 of which the ends are wound so as to constitute hinges 7. These ends comprise two longitudinal notches 9 which thus define a central tongue which constitutes a flexion spring 11.

The pivoting element 3 likewise comprises, on one side, two longitudinal arms 13 which terminate by a double hinge 15, formed by an inner hinge 15*a* and an outer hinge 15*b*, and which are so disposed, in the transverse direction, that they can be positioned in the longitudinal notches 9 of the main element 1. It comprises at its other end a central tab 6 whose end is rolled so as to produce a hinge 8 intended to be connected to one of the ends of the strap of the wristwatch.

The main (1) and pivoting (3) elements are connected by a pivot pin 16 which is fitted by force in the hinges 7 of the main element 1 and the inner hinges 15*a* of the pivoting element 3. A stop pin 18 is force-fitted in the hinges 15*b*.

When the clasp is in position of closure, in other words in position of use, as shown in FIG. 4, the flexion springs 11 are in abutment on their respective stop pins 18, so that they exert thereon a force creating a torque on the pivoting elements 3 (by reason of the stagger e existing between the pivot pin 15 and the stop pin 18) tending to apply them elastically against the main element 1, so that they then ensure the elastic support in closed position of the clasp.

The arms of the main (1) and pivoting (3) elements will preferably be provided with respective ribs 20 and 22 which will allow their rigidity to be controlled.

When the user wishes to remove the wristwatch, he/she pivots the main element and pivoting element of the clasp to bring the latter into the position shown in FIG. 3 and, as soon as the two main (1) and pivoting (3) elements are substantially in line with each other, the flexion spring 11 ceases to be in abutment on the stop pin 18, with the result that, in that case, it no longer exerts a torque on the pivoting element 3.

When, as in the form of embodiment shown in the Figures, the space included between the arms 13 of the pivoting element 3 extends inwardly to constitute a window 24 whose dimensions are greater than those of the end of the spring 11, it is then possible to pivot the two elements to a greater extent, since, during this movement, the end of the spring 11 has the possibility of traversing the window 24.

Figure 1:
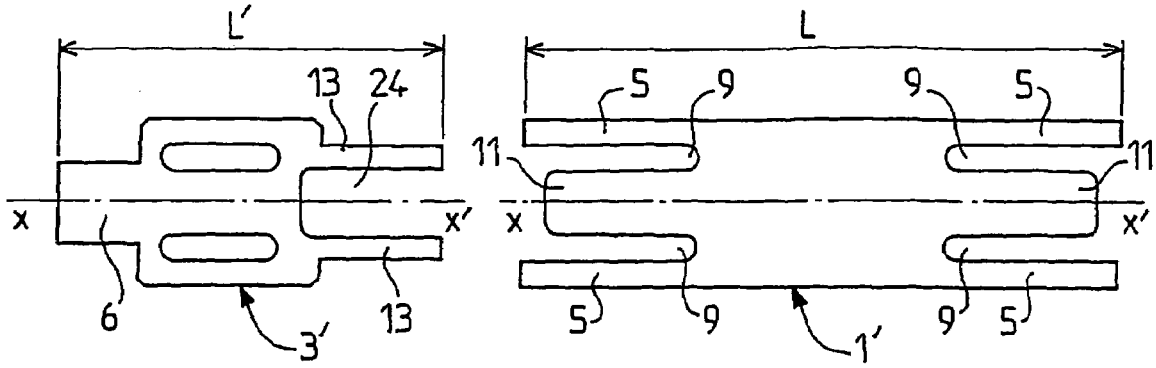
FIG. 1 is a plan view of the blanks constituting the main and pivoting elements of an example of clasp according to the invention.

Each of the main (1) and pivoting (3) elements is obtained from a strip of stainless steel which is cut out, for example by a stamping operation, so as to constitute two respective blanks 1' and 3', as shown in FIG. 1.

According to the invention, the strip presents a rigidity which is equal to that which it is desired to give the flexion spring 11, in order that the latter be in a position to perform its functions as specified previously.

The hinges 7 and 15 of the main (1) and pivoting (3) elements are formed by winding the ends of the respective arms 5 and 13 and welding the ends of the latter on the corresponding elements. This welding operation will preferably be effected with the aid of means allowing an extreme precision and in particular by means of the laser beam type.

However, for such a rolling to be possible, it is necessary that at least those parts of the arms 5 and 13 which will be wound, i.e. their ends, present a slight stiffness and this is why, prior to the winding operation, the ends of these arms will be heated so as to subject them to annealing. This operation will have to be very localized in order not to lessen the mechanical qualities of the other parts of the blanks, and means of the laser beam type will be employed to that end.

Manufacture of the main (1) and pivoting (3) elements will preferably be effected by a continuous process in which the blanks are arranged in a continuous band (or blank band 12), each blank being connected to the blanks which are adjacent thereto by connecting tabs 4.

Figure 5:
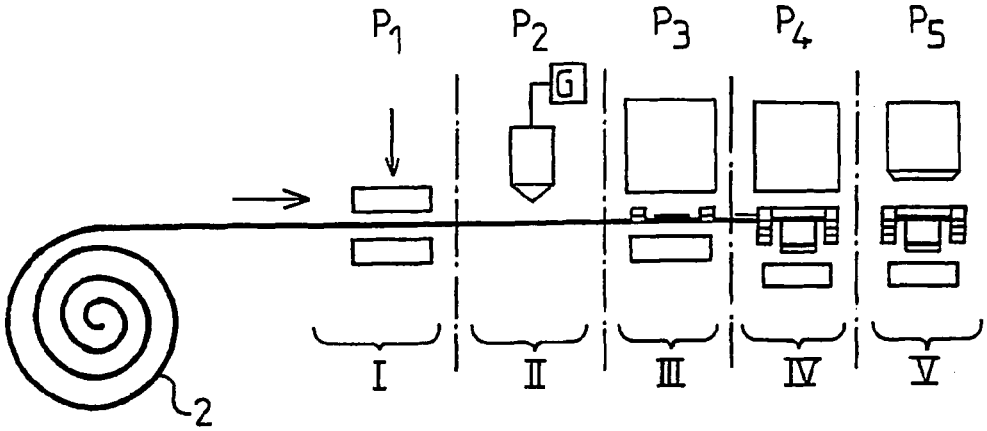
FIG. 5 is a schematic view in elevation of an example of installation allowing a clasp according to the invention to be manufactured.
Figure 6:
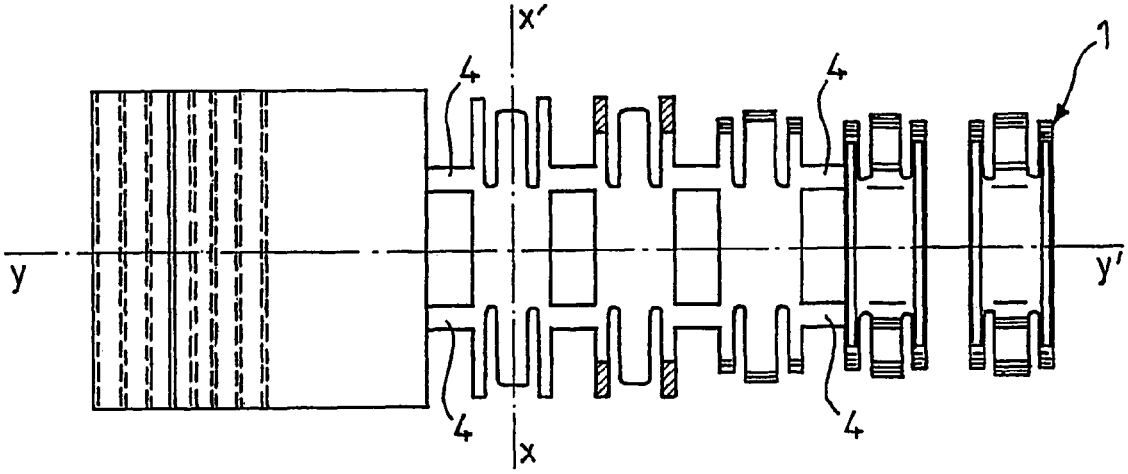
FIG. 6 is a schematic plan view of a blank band in the course of the process of manufacture.

Such an example of implementation of the invention will be described hereinafter, of which certain of the steps are represented in FIGS. 5 and 6. In this example of implementation, the blanks 1' and 3' are disposed transversely with respect to the metal strip, i.e. their longitudinal axis xx' is perpendicular to the longitudinal axis yy' of the strip.

FIGS. 5 and 6 shows the different successive phases of the process allowing the main element 1 of the clasp to be made from a rolled up strip 2 which unwinds all along the process and advances in front of different work stations $P_1$, $P_2$, . . . , $P_5$, corresponding respectively to machining steps I, II, . . . , V.

In the first step I, the strip 2 passes in the cut-out station $P_1$ where the blank 1' is formed, this cut-out being such that the blank is connected to each of the blanks 1' which are adjacent thereto by two connecting tabs 4 so as to form a blank band 12, so that it is possible to maintain all along the chain the advantages associated with this type of arrangement.

During the second step II, the blank band 12 moves in front of station $P_2$ which is constituted by a laser beam which effects a very localized heating on the two longitudinal edges of the strip which corresponds to the two ends of the blank 1' and more precisely to the ends of the arms 5. The width 1 of this treated band 10 (shown double-hatched in FIG. 6), corresponds to the length 1 of the arms which will subsequently be rolled up to make the hinge 7. This length will be limited so as not to reduce the stiffness of the flexion spring 11. The person skilled in the art will know how to adjust the power of the tool as well as the speed of advance of the blank 1' in front of the latter so that the metal is taken to the appropriate temperature to effect an efficient annealing.

In the course of the third step III, the ends of the arms 5 are rolled up so as to form the hinges 7, at the two ends of the blank 1'. When the production chain will manufacture the pivoting elements 3, double hinges will be produced at one of the ends thereof, i.e. they will be constituted by a rolling slightly flattened at its centre which will enable it to receive, on the inner hinge 15*a*, the pivot pin 16 and, on the outer hinge 15*b*, the stop pin 18.

In the course of the fourth step IV, a rib is made, at station $P_4$, on each of the arms of the pivoting element 3 which will make it possible to compensate its loss of rigidity provoked by the annealing operation.

By these various operations, each part constituting these elements is given the inherent rigidity which is necessary for it to ensure correct functioning and appropriate reliability of the clasp.

In the course of the fifth and last step V, at station $P_5$, a cut-out machine is employed for shearing and eliminating the connecting tabs 4 which join the blanks 1' together.

More or fewer than two connecting tabs 4 might, of course, be used in accordance with the invention.

The clasps according to the invention may be made with numerous types of metals. However, in the domain of clasps intended for time-keeping products, preference will be given to a stainless steel with high content of elements such as nickel, chromium, molybdenum, cobalt, the sum of the contents of these elements preferably being greater than 80%, by reason of its real and recognized qualities of inoxydability in highly oxydizing environments, such as those to which these products are subjected when they are in contact with users' wrists.

Although the example of clasp described is of the type with double development, the present invention is, of course, equally well applicable to a clasp of the type with single development which, in that case, would comprise only one pivoting element 3.

As shown in FIG. 7, it might, of course, be possible to effect a kinematic reversal of the support of the flexion spring by making the latter on a pivoting element, and the window 24 on the main element.

The invention claimed is:

1. Method for manufacturing a clasp, particularly for wristwatch strap, from a metal strip, of the type comprising a main element and at least one pivoting element, which are connected at one of their respective ends by an articulation, a flexion spring fastened with one of these elements being applied, at least in position of closure, on the other element in order to support it elastically in this position of closure, characterized in that it comprises the steps consisting in:

using a strip whose stiffness is the one desired for the spring, making, by cut-out, a blank of each of these elements, so as to form on each of them at least two longitudinal arms, and on the main element two recesses inside the two arms forming therebetween a central flexion spring, subjecting these arms to an annealing exclusively at their ends so as to allow rolling thereof, increasing the stiffness of these arms by making at least one rib along the longitudinal axis thereof.

2. Method according to claim 1, characterized in that it comprises a step during which a blank band is constituted from a strip constituted by a wound band, whose width corresponds to one of the dimensions of the element to be made, each of the blanks constituting the blank band being connected to the blanks which are adjacent thereto by at least one connecting tab.

3. Method according to claim 2, characterized in that the blanks are disposed so that their longitudinal axis is oriented perpendicularly to the longitudinal axis of the blank band.

4. Method according to claim 1, characterized in that the blank band advances, along its longitudinal axis, in front of localized heating means in zones disposed on its transverse edges, so as to effect an operation of annealing on at least one longitudinal band of the blank band.

5. Method according to claim 1, characterized in that the localized heating means are constituted by a laser beam generator.

6. Method according to claim 1, characterized in that, after the heating phase (II), an operation of rolling (III) is effected at the end of the arms of the elements, so as to constitute hinges.

7. Method according to claim 6, characterized in that two arms of the same end of a pivoting element are wound so as to constitute a double hinge, namely an inner hinge intended to receive a pivot pin common with the main element and an outer hinge intended to receive a stop pin.

8. Method according to claim 6, characterized in that it comprises a step consisting in welding the end of the arm, once the latter is wound, on the element on which it is constituted.

9. Method according to claim 7, characterized in that this welding is effected by a laser beam generator.

10. Method according to claim 1, characterized in that it comprises a step (IV) after the annealing operation (II), in the course of which longitudinal stiffening ribs are made on the arms of the main and pivoting elements.

11. Method according to claim 1, characterized in that it comprises a last phase (V) during which the tabs for connection of the elements are eliminated.

* * * * *